US010022969B2

(12) United States Patent
Hyakudome et al.

(10) Patent No.: US 10,022,969 B2
(45) Date of Patent: Jul. 17, 2018

(54) PRINT DEVICE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventors: Takao Hyakudome, Nagoya (JP); Naoki Mizuno, Takahama (JP); Takamitsu Nakajima, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/274,740

(22) Filed: Sep. 23, 2016

(65) Prior Publication Data

US 2017/0087852 A1 Mar. 30, 2017

(30) Foreign Application Priority Data

Sep. 30, 2015 (JP) ..... 2015-192379

(51) Int. Cl.
*B41J 2/165* (2006.01)
*B41J 2/21* (2006.01)
*B41J 3/407* (2006.01)

(52) U.S. Cl.
CPC ..... *B41J 2/16526* (2013.01); *B41J 2/16538* (2013.01); *B41J 2/16541* (2013.01); *B41J 2/2117* (2013.01); *B41J 3/4078* (2013.01); *B41J 2002/16573* (2013.01)

(58) Field of Classification Search
CPC ..... B41J 2/16544; B41J 2/16535; B41J 2/16552; B41J 2/2114; B41J 2/211; B41J 2/2117; B41J 2/165; B41J 2/16526; B41J 2/16538; B41J 2/16541; B41J 3/4078; B41J 2002/16573
See application file for complete search history.

(56) References Cited

U.S. PATENT DOCUMENTS

2011/0018921 A1* 1/2011 Fujisawa ..... B41J 2/04551 347/10
2012/0026230 A1* 2/2012 Danzuka ..... B41J 2/16526 347/14

FOREIGN PATENT DOCUMENTS

JP 2013-071405 A 4/2013

* cited by examiner

*Primary Examiner* — Sharon A Polk
(74) *Attorney, Agent, or Firm* — K&L Gates LLP

(57) ABSTRACT

A print device includes a head, a recovery portion, a processor, and a memory. The head is configured to eject a first ink for base printing and a second ink for image printing. The first ink is ejected onto a print medium and the second ink is ejected on the base printing to print image printing. The recovery portion is configured to perform recovery processing. The recovery processing recovers an ejection performance of the first ink of the head. The memory stores computer-readable instructions. When the computer-readable instructions are executed by the processor, the processor acquires an integrated value of an ejection amount of the first ink. And the processor also determines, based on the acquired integrated value, whether to perform the recovery processing by the recovery portion.

13 Claims, 9 Drawing Sheets

PRINT DEVICE AND NON-TRANSITORY COMPUTER-READABLE MEDIUM

CROSS-REFERENCE TO RELATED APPLICATION

This application claims priority to Japanese Patent Application No. 2015-192379 filed on Sep. 30, 2015, the disclosure of which is herein incorporated by reference in its entirety.

BACKGROUND

The present disclosure relates to a print device and a non-transitory computer-readable medium.

An inkjet type print device is provided with a head ejecting ink from a nozzle surface, and performs printing on a print medium, which is a print target, during relative movement between the head and the print medium. Among this type of print device, there is a print device that can use a cloth as the print medium.

SUMMARY

If one of "ink adhesion to the nozzle surface," "viscosity increase or solidification of the ink adhered to the nozzle surface," and "viscosity increase or solidification of the ink inside the nozzles" occurs, an ink ejection failure occurs and print quality deteriorates. Therefore, the print device performs wiping. The wiping is processing that wipes the nozzle surface using a wiper, which is a wiping member made of rubber or the like. The print device performs flushing. The flushing is processing that ejects the ink inside the nozzles when printing is not performed.

In the print device, in order to secure good print quality, it is necessary to perform recovery processing, such as wiping, at an appropriate timing. The present disclosure addresses the problems described above.

Various exemplary embodiments of the general principles described herein provide a print device including a head, a recovery portion, a processor, and a memory. The head is configured to eject, onto a print medium, a first ink for base printing and a second ink for image printing to be printed on the base printing. The recovery portion is configured to perform recovery processing. The recovery processing recovers an ejection performance of the first ink of the head. The memory stores computer-readable instructions. The instructions, when executed by the processor, perform processes including acquiring an integrated value of an ejection amount of the first ink, and determining, based on the acquired integrated value, whether to perform the recovery processing by the recovery portion.

Exemplary embodiments herein provide a non-transitory computer-readable medium storing computer-readable instructions. When executed by a processor provided in a print device, the instructions perform processes including acquiring an integrated value of an ejection amount of the first ink, and determining, based on the acquired integrated value, whether to perform the recovery processing by the recovery portion.

BRIEF DESCRIPTION OF THE DRAWINGS

Embodiments will be described below in detail with reference to the accompanying drawings in which.

DETAILED DESCRIPTION

Mechanical Structure

Figure 1:
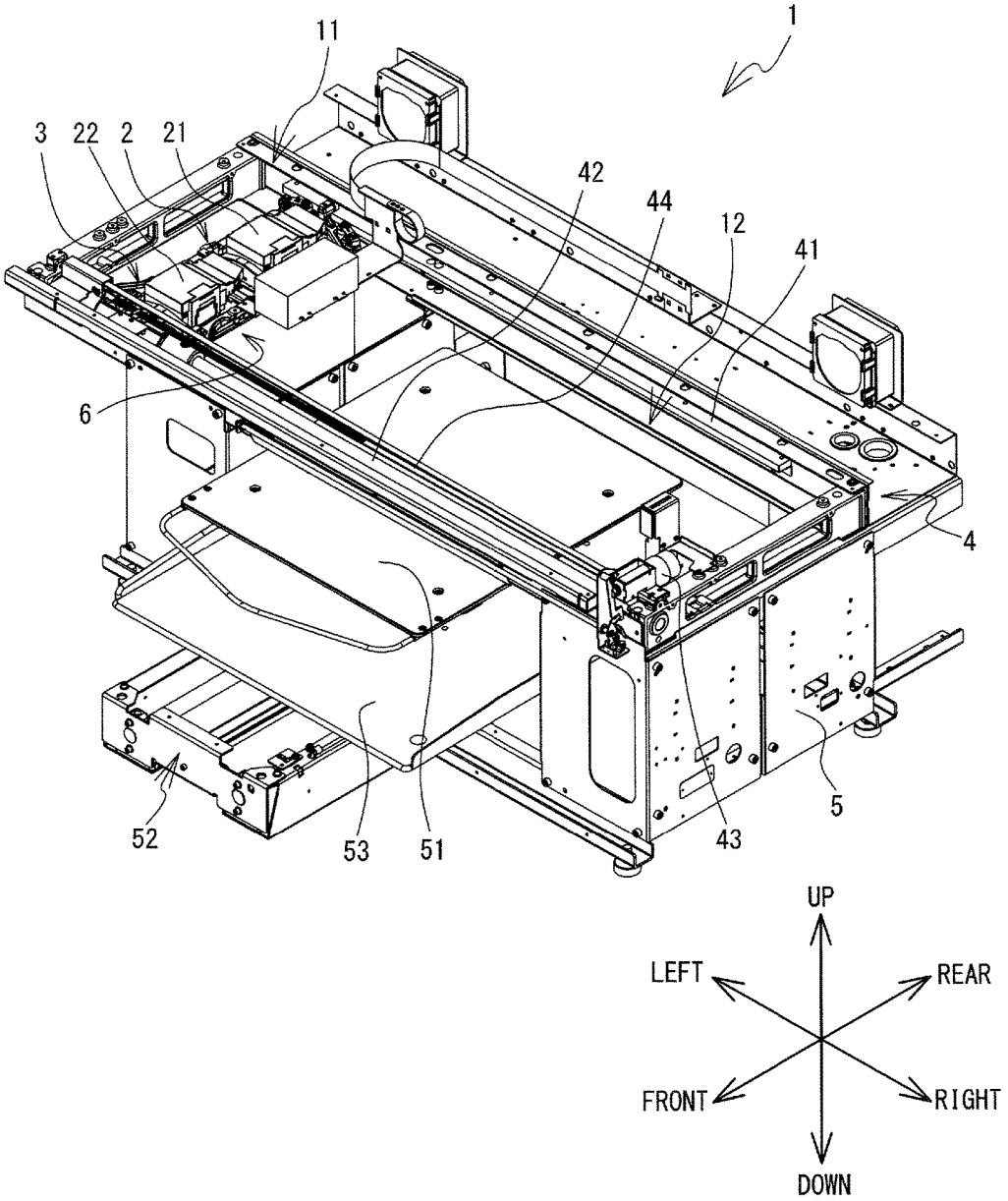
FIG. 1 is a perspective view showing an internal structure of a printer according to an embodiment.

In the following explanation, up and down directions, left and right directions, and front and rear directions are indicated by arrows in the drawings. In the drawings, the left-right direction is referred to as a main scanning direction. In the drawings, the front-rear direction is referred to as a sub-scanning direction.

FIG. 1 shows an internal structure of a printer 1 when an outer cover of the printer 1 is omitted. The inkjet type printer 1 can perform printing on a cloth, which is a print medium. Examples of the cloth include a nonwoven fabric. In addition to clothing fabric, clothes such as a T-shirt can be used as the print medium.

The printer 1 that corresponds to a print device of the present disclosure can perform multi-color printing on the print medium using five types of liquid ink whose colors are different from each other. The five types of ink are white ink, black ink, yellow ink, cyan ink and magenta ink. Color inks are a collective term for the four types of ink other than the white ink. The white ink contains a white pigment, such as titanium oxide. The white pigment is a component having a higher settleability than components contained in the color inks. The white ink is mainly used for base printing. The color inks are used for image printing that is printed on the base printing.

As shown in FIG. 1, the printer 1 is provided with a head 2, a carriage 3, an upper frame body 4, a lower frame body 5 and a recovery portion 6. The head 2 is mounted on the carriage 3. The upper frame body 4 supports the carriage 3 such that the carriage 3 can reciprocate in the main scanning direction. Within a movable range of the head 2 in the main scanning direction, a section on the left end side is called a non-print area 11. Within the aforementioned movable range, a section other than the non-print area 11 is called a print area 12. The upper frame body 4 is mounted on an upper portion of the lower frame body 5. The recovery portion 6 is mounted on the upper frame body 4, in a position below the carriage 3 when the head 2 is in the non-print area 11. The recovery portion 6 faces the head 2 in the non-print area 11.

Figure 2:
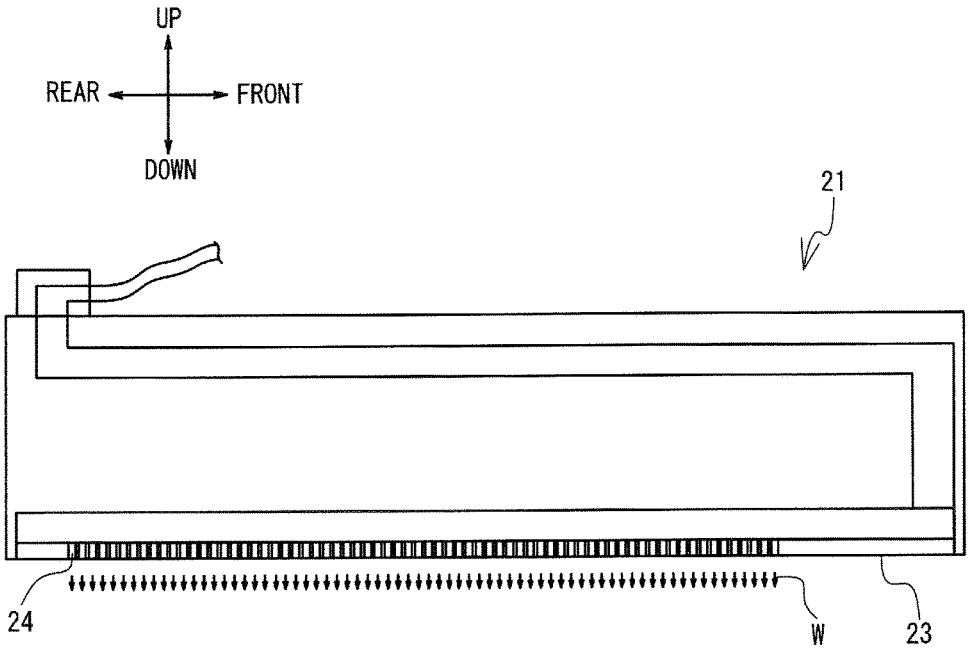
FIG. 2 is a cross-sectional view of a first head portion shown in FIG. 1.
Figure 3:
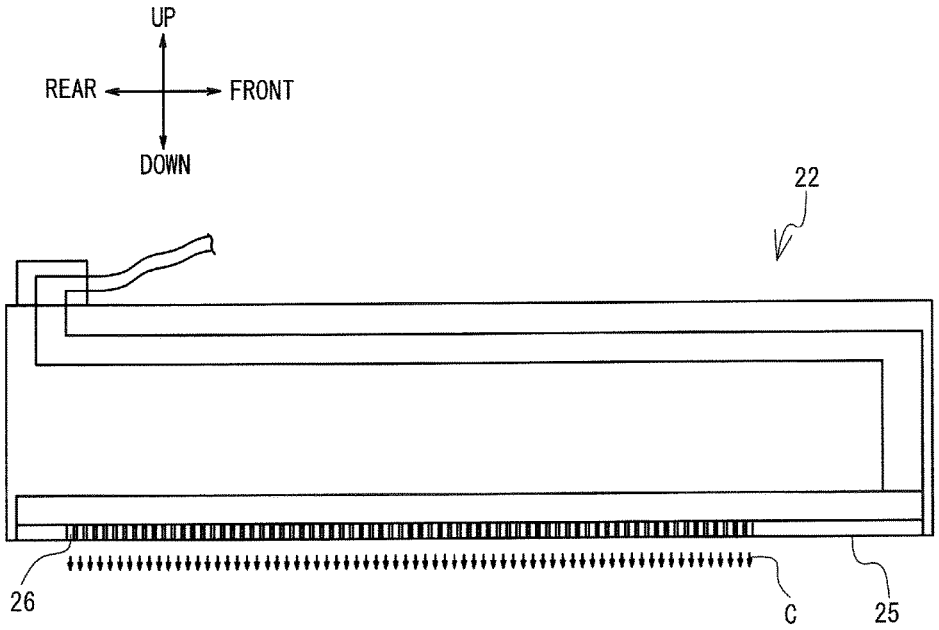
FIG. 3 is a cross-sectional view of a second head portion shown in FIG. 1.

The head 2 is provided with a first head portion 21 and a second head portion 22. The first head portion 21 is located to the rear of the second head portion 22. In other words, the first head portion 21 and the second head portion 22 are aligned in the sub-scanning direction. As shown in FIG. 2, the first head portion 21 has a first nozzle surface 23 that is a lower side surface. A plurality of first nozzle holes 24 are formed in the first nozzle surface 23. The first head portion 21 ejects the white ink from the first nozzle holes 24 (refer to arrows W shown in FIG. 2). As shown in FIG. 3, the second head portion 22 has a second nozzle surface 25 that is a lower side surface. A plurality of second nozzle holes 26 are formed in the second nozzle surface 25. The second head portion 22 ejects the color inks from the second nozzle holes 26 (refer to arrows C shown in FIG. 3).

As shown in FIG. 1, the upper frame body 4 is rectangular when viewed from above, and the inside of the upper frame body 4 has a rectangular space in which the carriage 3 is movable in the main scanning direction. A rear side section of the upper frame body 4 that extends in the main scanning direction fixedly supports a rail 41. The rail 41 extends in the main scanning direction. A front side section of the upper frame body 4 that extends in the main scanning direction fixedly supports a guide shaft 42. The guide shaft 42 extends in the main scanning direction. The rail 41 and the guide shaft 42 face each other on both sides of the space in which the carriage 3 is movable in the main scanning direction. A carriage motor 43 is mounted on the upper frame body 4, on one end side of the guide shaft 42. The carriage motor 43 can rotate in the forward and reverse directions, and is coupled to the carriage 3 via a carriage belt 44.

The lower frame body 5 is box shaped, and a platen 51, a platen movement mechanism 52 and a tray 53 are mounted on the inside of the lower frame body 5. The platen 51 is a plate-shaped member that extends in the main scanning direction and the sub-scanning direction, and supports the print medium. The platen movement mechanism 52 supports the platen 51 such that the platen 51 can reciprocate in the sub-scanning direction. The tray 53 is a plate-shaped member that extends in the main scanning direction and the sub-scanning direction, and is positioned between the platen 51 and the platen movement mechanism 52. The tray 53 is larger than the platen 51 in the main scanning direction and the sub-scanning direction. Thus, for example, when the print medium is clothing that has sleeves, the tray 53 supports the sleeves on an upper surface thereof such that the sleeves do not come into contact with a component inside the lower frame body 5.

As a result of the movement of the carriage 3 in the main scanning direction, the head 2 relatively moves in the main scanning direction with respect to the print medium supported by the platen 51. As a result of the movement of the platen 51 in the sub-scanning direction, the head 2 relatively moves in the sub-scanning direction with respect to the print medium supported by the platen 51. Since the first head portion 21 and the second head portion 22 are mounted on the carriage 3, the first head portion 21 and the second head portion 22 integrally and relatively move with respect to the print medium supported by the platen 51. While the head 2 repeats the relative movement with respect to the print medium in the main scanning direction and the sub-scanning direction, the head 2 ejects at least the white ink or one of the color inks during the relative movement in the main scanning direction with respect to the print medium, thus a print operation is performed. The first head portion 21 ejects the white ink onto the print medium supported by the platen 51, and forms the base printing. The second head portion 22 ejects the color inks onto the print medium after the base printing has been formed, and forms color image printing.

The recovery portion 6 performs recovery processing that recovers an ink ejection performance of the head 2. The recovery portion 6 is provided with a first recovery portion 61 and a second recovery portion 62. The first recovery portion 61 faces the first head portion 21 when the first head portion 21 is in the non-print area 11, and thus recovers the ejection performance of the white ink. The second recovery portion 62 faces the second head portion 22 when the second head portion 22 is in the non-print area 11, and thus recovers the ejection performance of the color inks.

Figure 4:
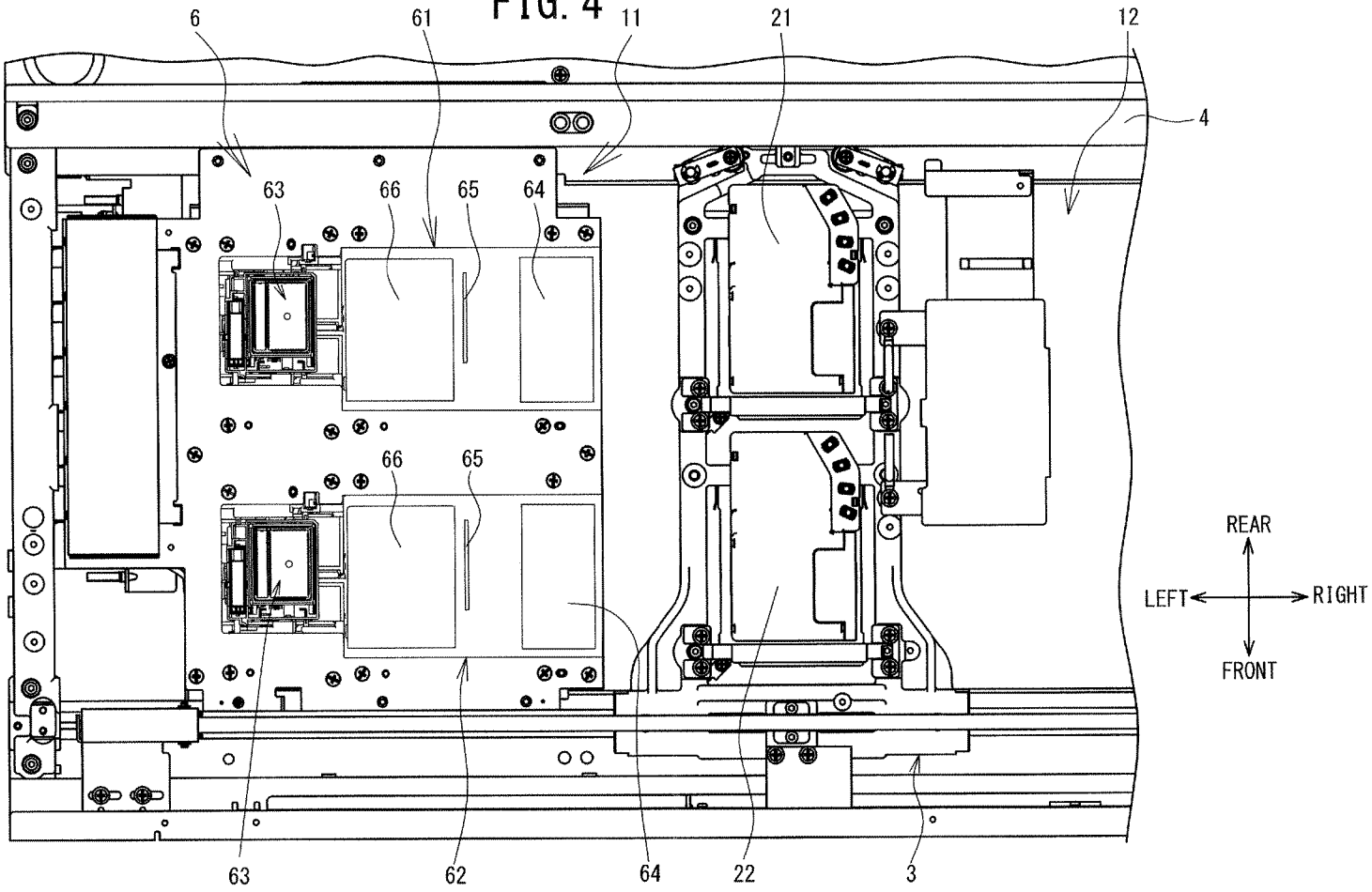
FIG. 4 is a partially enlarged plan view of the internal structure shown in FIG. 1.

As shown in FIG. 4, the first recovery portion 61 is provided with a purge portion 63, a flushing portion 64, a wiper 65 and a wiper cleaner 66. The second recovery portion 62 is provided with the purge portion 63, the flushing portion 64, the wiper 65 and the wiper cleaner 66.

The first recovery portion 61 will be explained with reference to FIG. 2 and FIG. 4. The purge portion 63 is positioned to the left of the flushing portion 64, the wiper 65 and the wiper cleaner 66. The purge portion 63 performs a purge operation in the first recovery portion 61, in a position farthest from the print area 12. The purge portion 63 draws the white ink inside the first nozzle holes 24 to the outside using a negative pressure, and removes bubbles and foreign materials inside the first nozzle holes 24. The flushing portion 64 is located in the first recovery portion 61, in a position closest to the print area 12. The flushing portion 64 is provided with a waste ink reservoir. The first head portion 21 performs flushing above the flushing portion 64. During the flushing, for example, all the first nozzle holes 24 forcibly eject the white ink toward the waste ink reservoir. The flushing reduces the possibility of a viscosity increase occurring in the white ink inside the first nozzle holes 24. The wiper 65 wipes the first nozzle surface 23. The wiper cleaner 66 moves to the right from an initial position shown in FIG. 4, removes the white ink on the wiper 65, and thereafter returns to the initial position. The above-described operation of the wiper cleaner 66 is hereinafter referred to as wiper cleaning.

The second recovery portion 62 will be explained with reference to FIG. 3 and FIG. 4. The purge portion 63 performs the purge operation in the second recovery portion 62, in a position farthest from the print area 12. The purge portion 63 draws the color inks inside the second nozzle holes 26 to the outside using a negative pressure, and removes bubbles and foreign materials inside the second nozzle holes 26. The flushing portion 64 is located in the second recovery portion 62, in a position closest to the print area 12. The second head portion 22 performs flushing above the flushing portion 64. During the flushing, for example, all the second nozzle holes 26 forcibly eject the color inks toward a waste ink reservoir. The flushing reduces the possibility of a viscosity increase occurring in the color inks inside the second nozzle holes 26. The wiper 65 wipes the second nozzle surface 25. The structure and operation of the wiper cleaner 66 of the second recovery portion 62 are the same as those of the wiper cleaner 66 of the first recovery portion 61.

As explained above, the recovery portion 6 can perform the wiping of the first nozzle surface 23 and the second nozzle surface 25 by the wipers 65, the purge operations of the first nozzle holes 24 and the second nozzle holes 26 using the purge portions 63, and the flushing of the first nozzle holes 24 and the second nozzle holes 26 in the flushing portions 64. The wiping of the first nozzle surface 23 by the wiper 65 is hereinafter referred to as wiping of the first nozzle surface 23.

Electrical Configuration

Figure 5:
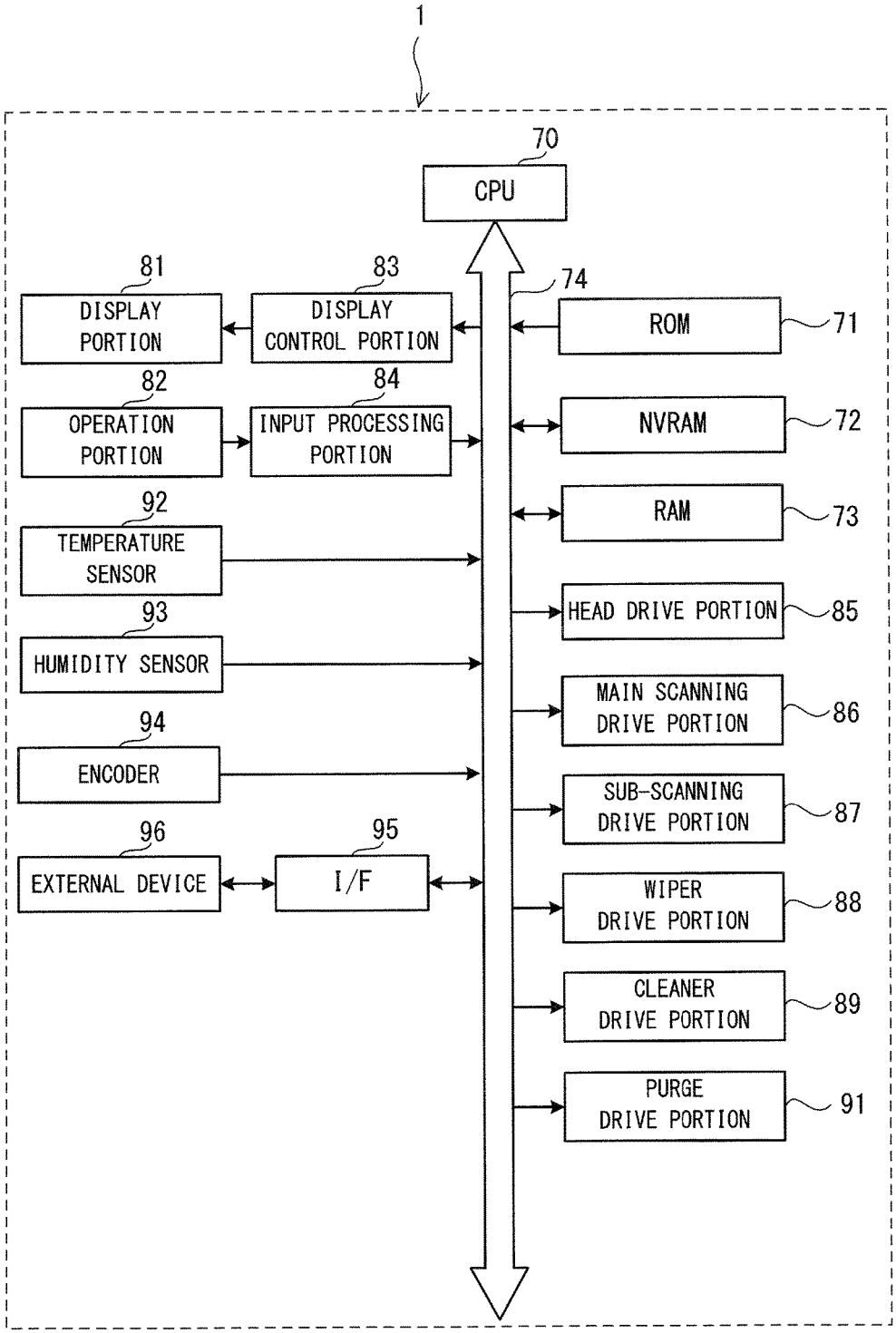
FIG. 5 is a block diagram showing an electrical configuration of the printer according to the embodiment.

As shown in FIG. 5, the printer 1 is provided with a CPU 70, a ROM 71, a NVRAM 72, a RAM 73 and a bus 74. The CPU 70 is connected to the ROM 71, the NVRAM 72 and the RAM 73 via the bus 74. The CPU 70 is a microprocessor and controls overall operation of the printer 1. The ROM 71 stores various programs and the like such that they cannot be erased. The NVRAM 72 is a rewritable and nonvolatile storage medium, and maintains stored information even during power off. The NVRAM 72 stores, in a rewritable manner, at least a control program of the recovery portion 6. The CPU 70 reads out a recovery control program from the NVRAM 72 and executes the recovery control program, thus controlling recovery processing. The RAM 73 temporarily stores various data when the program is executed.

The printer 1 is provided with a display portion 81 that performs various types of display, and an operation portion 82 that receives an operation input by a user. The display portion 81 is connected to the bus 74 via a display control portion 83. The display control portion 83 controls the display of the display portion 81 based on a command signal from the CPU 70. The operation portion 82 is connected to the bus 74 via an input processing portion 84. The input processing portion 84 outputs, to the CPU 70, an input signal in response to the operation input on the operation portion 82.

A head drive portion 85, a main scanning drive portion 86, a sub-scanning drive portion 87, a wiper drive portion 88, a cleaner drive portion 89, a purge drive portion 91, a temperature sensor 92, a humidity sensor 93, an encoder 94 and an interface 95 are connected to the bus 74. The head drive portion 85 is connected to the first head portion 21 and the second head portion 22 (refer to FIG. 1), and drives piezoelectric elements provided on the first head portion 21 and the second head portion 22. The main scanning drive portion 86 drives the carriage motor 43 (refer to FIG. 1). The sub-scanning drive portion 87 drives the platen movement mechanism 52 (refer to FIG. 1). The wiper drive portion 88 moves the wiper 65 in the up-down direction. The cleaner drive portion 89 moves the wiper cleaner 66 in the left-right direction when the wiper cleaning is performed. The purge drive portion 91 performs the purge operation by driving the purge portion 63.

The temperature sensor 92 outputs a signal corresponding to an operating environment temperature of the printer 1. The operating environment temperature indicates a temperature under an installation environment of the printer 1. The humidity sensor 93 outputs a signal corresponding to an operating environment humidity of the printer 1. The operating environment humidity indicates a humidity under the installation environment of the printer 1. The lower frame body 5 (refer to FIG. 1) of the printer 1 supports the temperature sensor 92 and the humidity sensor 93. The encoder 94 outputs a rectangular wave signal in accordance with the movement of the carriage 3 (refer to FIG. 1) in the main scanning direction. The upper frame body 4 (refer to FIG. 1) of the printer 1 supports the encoder 94. The CPU 70 is connected to an external device 96 via the interface 95. The printer 1 can transmit and receive information to and from the external device 96 via the interface 95.

Operation Explanation

A basic operation of the configuration of the present embodiment will be explained with reference to FIG. 5. The CPU 70 reads out an operation control program of the printer 1 from the ROM 71 or the NVRAM 72, and executes the operation control program. The CPU 70 controls respective portions, such as the head drive portion 85. The printer 1 performs various processing including the printing on the print medium.

The recovery processing of the present embodiment will be explained. The CPU 70 reads out the recovery control program from the NVRAM 72 and executes the recovery control program. The CPU 70 controls the head drive portion 85, the main scanning drive portion 86, the wiper drive portion 88 and the like. The printer 1 performs the recovery processing by the recovery portion 6.

The recovery processing of the first nozzle holes 24 will be explained. The CPU 70 acquires an integrated value of the ejection amount of the white ink. The integrated value of the ejection amount of the white ink can be acquired based on, for example, a signal transmitted by the CPU 70 to the head drive portion 85. For example, the CPU 70 starts to calculate the integrated value from a start time of the base printing immediately after the previous execution of the wiping of the first nozzle surface 23, and resets the integrated value to an initial value of 0 when the CPU 70 determines the execution of the wiping of the first nozzle surface 23.

The CPU 70 acquires a number of scans. The number of scans is a number of times of the movement in the main scanning direction of the head 2, namely, the carriage 3. The number of scans can be acquired based on an output of the encoder 94, for example. The CPU 70 acquires a cumulative number of scans. The cumulative number of scans is a cumulative number of times of the relative movement of the head 2 in the main scanning direction with respect to the print medium. For example, the cumulative number of scans is a cumulative value of the number of scans after the previous execution of the flushing of the first nozzle holes 24. The CPU 70 acquires a number of empty feeds. The number of empty feeds is a number of times of the relative movement of the head 2 in the main scanning direction with respect to the print medium in a state in which the white ink is not ejected during the print operation. More specifically, the number of empty feeds is the number of scans in a state in which the white ink is not ejected during the print operation. The number of empty feeds can be acquired based on, for example, the output of the encoder 94 and the signal transmitted by the CPU 70 to the head drive portion 85.

The CPU 70 determines whether to perform the recovery processing by the recovery portion 6, based on the integrated value of the ejection amount of the white ink. When a large amount of the white ink is used, there is a high possibility that the amount of the white ink adhered to the first nozzle surface 23 is large, and also there is a high possibility that a meniscus formation state of openings of the first nozzle holes 24 is not favorable. In summary, there is a high possibility of an ejection failure of the first nozzle holes 24. Therefore, when the integrated value of the ejection amount of the white ink is equal to or more than a first reference value, the printer 1 performs the wiping of the first nozzle surface 23 and the flushing of the first nozzle holes 24. A reference time for the integrated value is, for example, a start time of the print operation or a time immediately after the previous execution of "the wiping of the first nozzle surface 23 and the flushing of the first nozzle holes 24."

The CPU 70 determines whether to perform the recovery processing by the recovery portion 6, based on the integrated value of the ejection amount of the white ink and the number of scans. More specifically, when the integrated value is less than the first reference value, the CPU 70 performs determination processing to determine "execution of the wiping of the first nozzle surface 23 and execution of the flushing of the first nozzle holes 24" or "non-execution of the wiping of the first nozzle surface 23 and execution of the flushing of the first nozzle holes 24" in accordance with the number of scans.

When a non-ejection state of the white ink continues for a long time during the print operation, there is a high possibility of the occurrence of a viscosity increase or solidification of the white ink inside the first nozzle holes 24, and there is a high possibility of the occurrence of ejection failures of the first nozzle holes 24. Therefore, when the number of empty feeds is equal to or more than a reference number of empty feeds, the printer 1 performs the flushing of the first nozzle holes 24. More specifically, when the integrated value of the ejection amount of the white ink is less than the first reference value and the number of empty feeds is equal to or more than the reference number of empty feeds, the CPU 70 determines that the flushing of the first nozzle holes 24 is to be performed. When the integrated value is equal to or less than a second reference value, the CPU 70 determines that the wiping of the first nozzle surface 23 is not to be performed. When the integrated value exceeds the second reference value, the CPU 70 determines that the wiping of the first nozzle surface 23 is to be performed. The second reference value is smaller than the first reference value.

When the flushing of the first nozzle holes 24 is performed after the non-ejection state of the white ink continues for a long time during the print operation, it is effective to perform the flushing immediately before the next ejection of the white ink. Therefore, when the number of empty feeds is equal to or more than the reference number of empty feeds, the printer 1 performs the flushing of the first nozzle holes 24 immediately before the next ejection of the white ink. More specifically, when the integrated value of the ejection amount of the white ink is less than the first reference value and the ejection of the white ink is scheduled during a time period from the relative movement of the head 2 performed this time in the main scanning direction with respect to the print medium to a predetermined number of relative movements in the main scanning direction, the CPU 70 determines that the flushing of the first nozzle holes 24 is to be performed when the number of empty feeds is equal to or more than the reference number of empty feeds.

When the use amount of the white ink is small, there is a high possibility of the occurrence of a viscosity increase or solidification of the white ink inside the first nozzle holes 24, and there is a high possibility of the occurrence of ejection failures of the first nozzle holes 24. Therefore, the printer 1 can regularly perform the flushing of the first nozzle holes 24. More specifically, when the integrated value of the ejection amount of the white ink is less than the first reference value and the cumulative number of scans reaches a reference number of scans, the CPU 70 determines whether to perform the flushing of the first nozzle holes 24 in accordance with whether or not the integrated value is equal to or less than a third reference value. The third reference value is smaller than the second reference value. When the integrated value is equal to or less than the third reference value, the CPU 70 determines that the wiping of the first nozzle surface 23 is not to be performed by the wiper 65 and that the flushing of the first nozzle holes 24 is to be performed. When the integrated value exceeds the third reference value, the CPU 70 determines that the wiping of the first nozzle surface 23 is not to be performed and that the flushing of the first nozzle holes 24 is not to be performed.

The recovery processing of the second nozzle holes 26 will be explained. The components of the color inks are less likely to be deposited than those of the white ink. When a cloth is used as the print medium, the use amount of the color inks is smaller than that of the white ink. The possibility of the occurrence of ejection failures of the color inks in the second nozzle holes 26 is lower than the possibility of the occurrence of ejection failures of the white ink in the first nozzle holes 24. Therefore, the frequency of the recovery processing of the second nozzle holes 26 can be equal to or smaller than the frequency of the recovery processing of the first nozzle holes 24.

For example, the printer 1 performs the recovery processing of the second nozzle holes 26 at the time of the recovery processing of the first nozzle holes 24, once in every N times (N is an integer of 1 or more) of the recovery processing of the first nozzle holes 24. The CPU 70 determines the execution of the flushing of the second nozzle holes 26 in a mode in which the flushing of the second nozzle holes 26 is performed when the flushing of the first nozzle holes 24 is performed. More specifically, the CPU 70 determines the execution of the recovery processing of the second nozzle holes 26, based on the execution determination of the recovery processing of the first nozzle holes 24. The execution determination of the wiping of the second nozzle surface 25 can be made in a similar manner.

As described in detail above, the printer 1 can perform the recovery processing of the first nozzle holes 24, which have a relatively higher possibility of the occurrence of ink ejection failures than the second nozzle holes 26, at an appropriate timing. Thus, the printer 1 can reduce the possibility of the occurrence of a viscosity increase or solidification of the ink inside the first nozzle holes 24. The printer 1 can reduce the adhesion of the ink to the first nozzle surface 23 at an appropriate timing. The printer 1 can reduce the possibility of the occurrence of a viscosity increase or solidification of the ink adhered to the first nozzle surface 23. Thus, the printer 1 can secure a favorable print quality.

The use amount of the ink for base printing is normally larger than the use amount of the ink for image printing that is printed on the base printing. Therefore, in the printer 1 that performs the base printing and the image printing, it is extremely important to recover the ink ejection performance of the first nozzle holes 24 for the base printing at an appropriate timing. When a cloth is used as the print medium, the use amount of the white ink is normally larger than the use amount of each of the color inks. For example, the number of the first nozzle holes 24 for ejecting the white ink is normally larger than the number of the second nozzle holes 26 for ejecting a certain one of the color inks. Therefore, in the printer 1 that can use a cloth as the print medium, it is extremely important to recover the ink ejection performance of the first nozzle holes 24 for ejecting the white ink at an appropriate timing. It is possible that the ink for base printing contains a component whose property is significantly different from that of a component of the ink for image printing. The property is settleability or the like in an ink solvent. The white ink, which is an example of the ink for base printing, contains a component having a higher settleability than that of each of the color inks. Therefore, in the printer 1 that can use a cloth as the print medium, it is extremely important to recover the ink ejection performance of the first nozzle holes 24 for ejecting the white ink, which is the ink for base printing, at an appropriate timing. The present embodiment can favorably solve these problems and can secure a favorable print quality.

Specific Example of Control Program

A specific example of the recovery control program will be explained. The recovery control program can be downloaded from the external device 96 via the interface 95. The NVRAM 72 stores, in a rewritable manner, the recovery control program downloaded from the external device 96 by the CPU 70. The CPU 70 reads out the recovery control program from the NVRAM 72 and executes the recovery control program. In the explanation below, S is an abbreviation for step.

Figure 6:
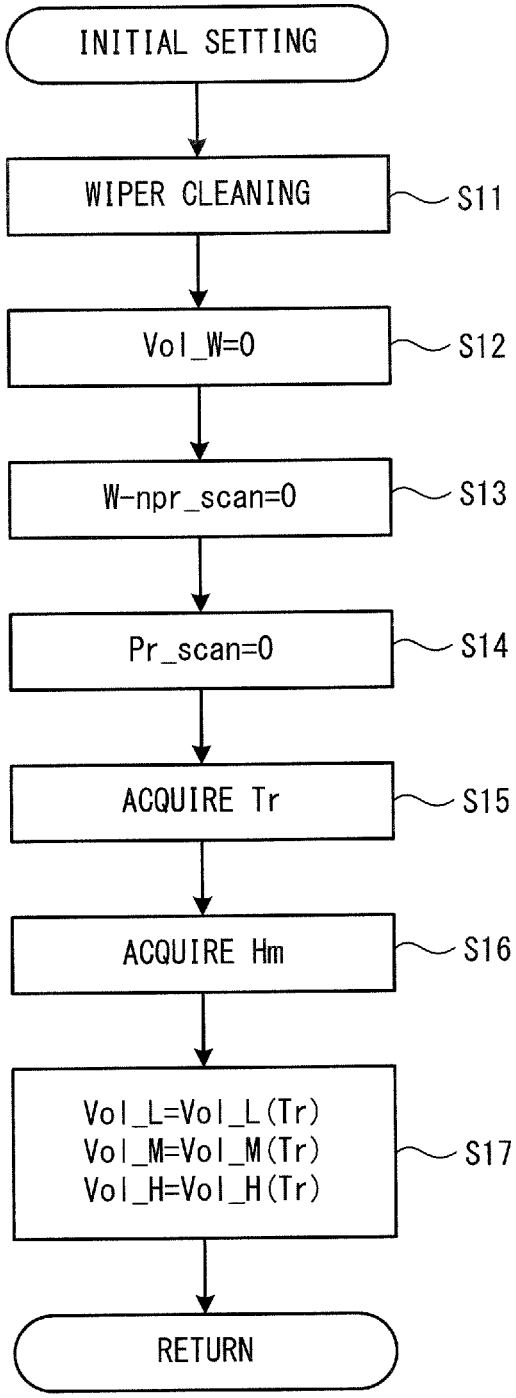
FIG. 6 is a flowchart showing an example of recovery control according to the embodiment.

When the CPU 70 detects that the user has input a print start command via the operation portion 82, the CPU 70 activates an initial setting routine shown in FIG. 6. In the initial setting routine, the CPU 70 performs processing from S11 to S17, and thereafter ends the initial setting routine. The initial setting routine does not include processing to stand by for particular processing in the printer 1 or a particular input into the CPU 70. Therefore, the initial setting routine is completed in a very short time (for example, a time period less than a time period required for the carriage 3 to move by one dot).

The CPU 70 determines that the wiper cleaning is to be performed (S11). The CPU 70 reads out a wiper cleaning execution routine from the ROM 71 or the NVRAM 72 after the completion of the initial setting routine, and executes the wiper cleaning execution routine. In this manner, the printer 1 performs the wiper cleaning. That is, the CPU 70 ends the initial setting routine without waiting for the completion of the wiper cleaning.

The CPU 70 resets the value of an integrated value Vol_W of the ejection amount of the white ink to an initial value of 0 (S12). The CPU 70 resets the value of a number of empty feeds W-npr_scan to an initial value of 0 (S13). The CPU 70 resets the value of a cumulative number of scans Pr_scan to an initial value of 0 (S14). The CPU 70 acquires a temperature Tr based on an output of the temperature sensor 92 (S15). That is, the temperature Tr is based on a signal output by the temperature sensor 92 corresponding to the operating environment temperature of the printer 1. The CPU 70 acquires a humidity Hm based on an output of the humidity sensor 93 (S16). That is, the humidity Hm is based on a signal output by the humidity sensor 93 corresponding to the operating environment humidity of the printer 1. Parameters for the integrated value Vol_W, the number of empty feeds W-npr_scan, the cumulative number of scans Pr_scan, and the like are stored in the NVRAM 72 or the RAM 73.

Based on the acquired temperature Tr, the CPU 70 sets a first reference value Vol_H, a second reference value Vol_M and a third reference value Vol_L (S17). The CPU 70 sets the first reference value Vol_H using a lookup table Vol_H (Tr) that defines a relationship between the temperature Tr and the first reference value Vol_H. The CPU 70 sets the second reference value Vol_M using a lookup table Vol_M (Tr) that defines a relationship between the temperature Tr and the second reference value Vol_M. The CPU 70 sets the third reference value Vol_L using a lookup table Vol_L (Tr) that defines a relationship between the temperature Tr and the third reference value Vol_L.

When a temperature Tr1 is smaller than a temperature Tr2, the following relationships are established in each of the lookup tables Vol_H (Tr), Vol_M (Tr) and Vol_L (Tr).

$$Vol_L(Tr) \leq Vol_M(Tr) \leq Vol_H(Tr)$$

$$Vol_H(Tr1) < Vol_H(Tr2)$$

$$Vol_M(Tr1) < Vol_M(Tr2)$$

$$Vol_L(Tr1) < Vol_L(Tr2)$$

In the present specific example, each of the lookup tables Vol_H (Tr), Vol_M (Tr) and Vol_L (Tr) has the following structure. When Vol_H (Tr) is less than a threshold temperature Tr0, it is a fixed value Vol_H1, and when Vol_H (Tr) is equal to or more than the threshold temperature Tr0, it is a fixed value Vol_H2. This also applies to Vol_M and Vol_L.

Based on the output of the encoder 94, the CPU 70 acquires a position of the carriage 3 in the main scanning direction and a movement direction of the carriage 3. The CPU 70 activates a white wiping/flushing determination routine shown in FIG. 7 and FIG. 8 at a predetermined time point. For example, the predetermined time point is a point in time at which the head 2 that is moving leftward reaches the leftmost end of the print area 12. This routine does not include processing to stand by for particular processing in the printer 1 or a particular input into the CPU 70. Therefore, this routine is completed in a very short time (for example, a time period less than the time period required for the carriage 3 to move by one dot).

Figure 7:
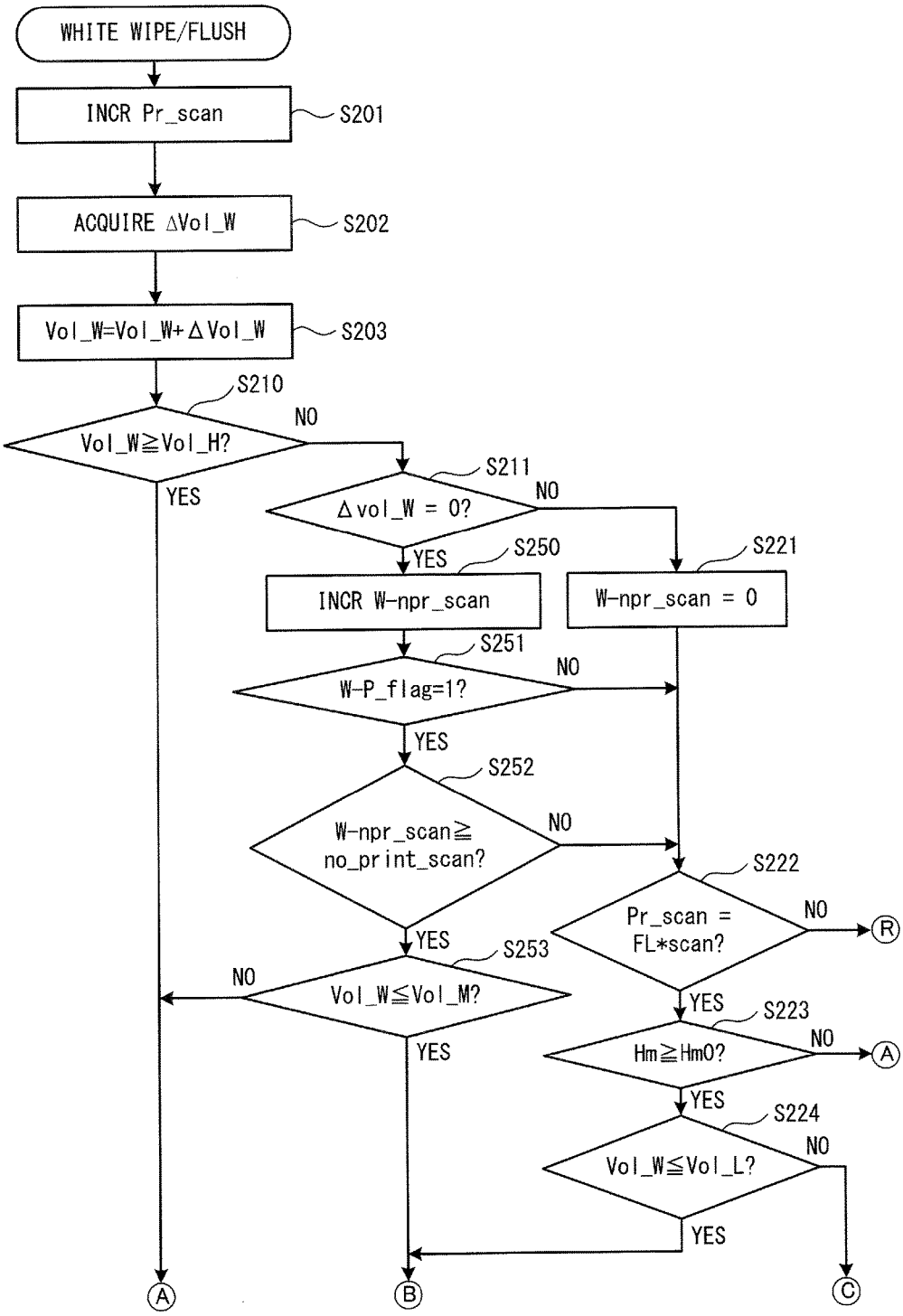
FIG. 7 is a flowchart showing an example of the recovery control according to the embodiment.
Figure 8:
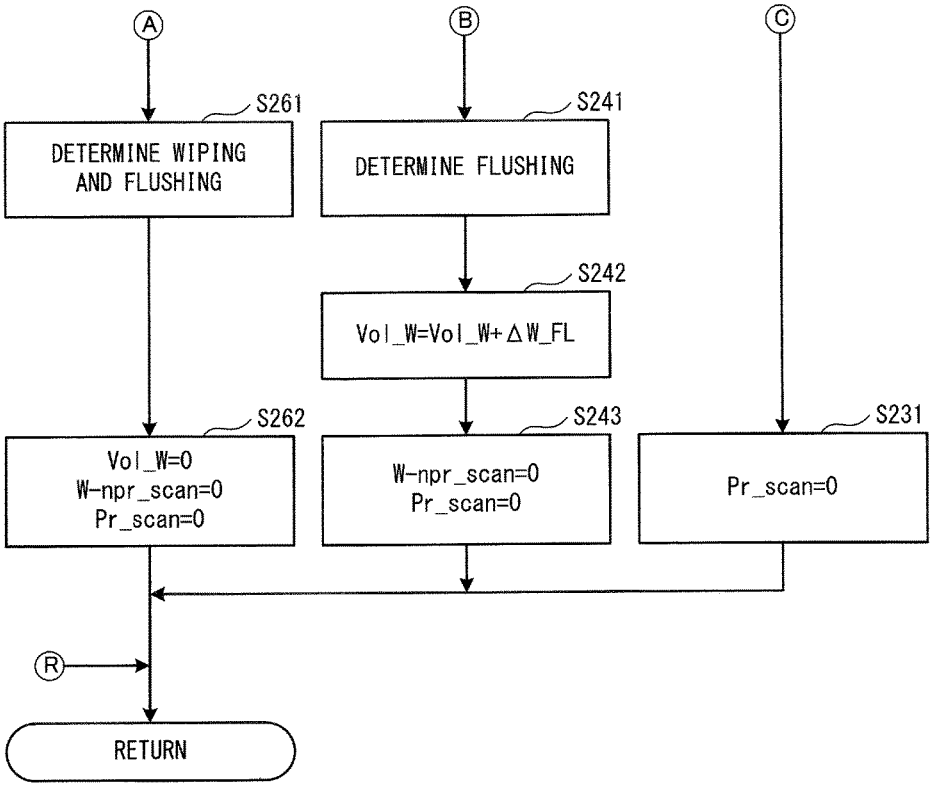
FIG. 8 is a flowchart showing an example of the recovery control according to the embodiment.

The white wiping/flushing determination routine shown in FIG. 7 and FIG. 8 will be explained. The CPU 70 increments the value of the cumulative number of scans Pr_scan by one (S201). The CPU 70 acquires a white ink ejection amount ΔVol_W (S202). The white ink ejection amount ΔVol_W is a total amount of the white ink ejected from the first head portion 21 during the immediately preceding scan. The immediately preceding scan is the relative movement of the head 2 in the main scanning direction with respect to the print medium immediately preceding the activation of the white wiping/flushing determination routine. More specifically, the immediately preceding scan is a leftward movement of the head 2 from the rightmost end of the print area 12 to the leftmost end of the print area 12, and is completed when the white wiping/flushing determination routine is activated. The white ink ejection amount ΔVol_W can be calculated, for example, by multiplying a white ink ejection pulse number during the immediately preceding scan by an amount of white ink droplets ejected from the first nozzle holes 24 per pulse. The white ink ejection pulse number is a total number of white ink ejection pulses input by the CPU 70 to the first head portion 21 via the head drive portion 85 during the immediately preceding scan. The white ink ejection pulse number can be easily acquired based on the data etc. stored in the RAM 73 when the first head portion 21 is driven.

The CPU 70 updates the integrated value Vol_W by adding the white ink ejection amount ΔVol_W to the integrated value Vol_W (S203). The CPU 70 determines whether or not the updated current integrated value Vol_W is equal to or more than the first reference value Vol_H (S210). For example, immediately after the wiping of the first nozzle surface 23 (refer to S262 to be described later) or immediately after the completion of the initial setting routine, the integrated value Vol_W is less than the first reference value Vol_H (no at S210). Therefore, the CPU 70 advances the processing to S211. At S211, the CPU 70 determines whether or not the white ink ejection amount ΔVol_W acquired at S202 this time is 0. This determination corresponds to a determination as to whether or not the head 2 was in the non-ejection state of the white ink in the immediately preceding scan.

The explanation below will be made on the assumption that the printer 1 performs the image printing using the color inks on the base printing performed using the white ink on a T-shirt or the like. When the base printing is being performed, the white ink ejection amount ΔVol_W is not 0. When the white ink ejection amount ΔVol_W is not 0 (no at S211), the CPU 70 resets the value of the number of empty feeds W-npr_scan to the initial value of 0 (S211), and advances the processing to S222.

At S222, the CPU 70 determines whether or not the cumulative number of scans Pr_scan has reached a reference number of scans FL*scan. The reference number of scans FL*scan is a constant and is 20, for example. When the cumulative number of scans Pr_scan has not reached the reference number of scans FL*scan (no at S222), the CPU 70 temporarily ends the present routine. When the cumulative number of scans Pr_scan has reached the reference number scans FL*scan (yes at S222), the CPU 70 advances the processing to S223.

At S223, the CPU 70 determines whether or not the humidity Hm is equal to or more than a threshold humidity Hm0. The threshold humidity Hm0 is 40 percent, for example. Hereinafter, a series of explanations will be made on the assumption that the humidity Hm is equal to or more than the threshold humidity Hm0 (yes at S223). The CPU 70 determines whether or not the integrated value Vol_W is equal to or less than the third reference value Vol_L (S224). When the integrated value Vol_W exceeds the third reference value Vol_L (no at S224), the CPU 70 resets the value of the cumulative number of scans Pr_scan to the initial value of 0 (S231), and temporarily ends the present routine. More specifically, for example, when the cumulative number of scans Pr_scan reaches the reference number of scans FL*scan during the base printing, if the integrated value Vol_W of the white ink ejection amount, i.e., the use amount of the white ink, exceeds the third reference value Vol_L, the printer 1 does not perform the recovery processing.

When the integrated value Vol_W is equal to or less than the third reference value Vol_L (yes at S224), the CPU 70 determines that the flushing of the first nozzle holes 24 is to be performed (S241), and updates the integrated value Vol_W by adding a white ink ejection amount ΔW_FL during the flushing to the integrated value Vol_W (S242). Further, the CPU 70 resets the value of the number of empty feeds W-npr_scan and the value of the cumulative number of scans Pr_scan to the initial value of 0 (S243), and temporarily ends the present routine. More specifically, for example, when the cumulative number of scans Pr_scan reaches the reference number of scans FL*scan during the base printing, if the use amount of the white ink is small, the printer 1 performs the flushing of the first nozzle holes 24. After the CPU 70 has temporarily ended the present routine, the CPU 70 reads out a flushing execution routine from the ROM 71 or the NVRAM 72 and executes the flushing execution routine, thus the printer 1 performs the flushing of the first nozzle holes 24. That is, the CPU 70 temporarily ends the present routine without waiting for the completion of the flushing of the first nozzle holes 24.

When the non-ejection state of the white ink occurs in the immediately preceding scan (yes at S211), the CPU 70 increments the number of empty feeds W-npr_scan by one (S250), and advances the processing to S251. At S251, the CPU 70 determines whether or not a white print flag W-P_flag is "1." When the ejection of the white ink by the first head portion 21 is scheduled within a predetermined number of scans N_W-P from immediately after the immediately preceding scan, the white print flag W-P_flag is "1." When the ejection of the white ink by the first head portion 21 is not scheduled within the predetermined number of scans N_W-P from immediately after the immediately preceding scan, the white print flag W-P_flag is "0." The predetermined number of scans N_W-P is two, for example.

When the white print flag W-P_flag is "0" (no at S251), the CPU 70 advances the processing to S222. When the white print flag W-P_flag is "1" (yes at S251), the CPU 70 advances the processing to S252. At step S252, the CPU 70 determines whether or not the number of empty feeds W-npr_scan is equal to or more than a reference number of empty feeds no_print_scan. During the base printing, normally, the number of empty feeds W-npr_scan is less than the reference number of empty feeds no_print_scan (no at S252). Therefore, the CPU 70 advances the processing to S222. When the number of empty feeds W-npr_scan reaches the reference number of empty feeds no_print_scan during the base printing (yes at S252), the CPU 70 advances the processing to S253.

At S253, the CPU 70 determines whether or not the integrated value Vol_W is equal to or less than the second reference value Vol_M. When the integrated value Vol_W is equal to or less than the second reference value Vol_M (yes at S253), the CPU 70 temporarily ends the present routine after performing the processing at S241 to S243. When the integrated value Vol_W exceeds the second reference value Vol_M (no at S253), the CPU 70 determines that the wiping of the first nozzle surface 23 is to be performed and the flushing of the first nozzle holes 24 is to be performed (S261). Further, the CPU 70 resets the integrated value Vol_W, the value of the number of empty feeds W-npr_scan and the value of the cumulative number of scans Pr_scan to the initial value of 0 (S262), and temporarily ends the present routine.

More specifically, when the number of empty feeds W-npr_scan reaches or exceeds the reference number of empty feeds no_print_scan (yes at S252), immediately before the next ejection of the white ink (yes at S251), the printer 1 performs the flushing of the first nozzle holes 24 (S241 or S261). When the use amount of the white ink exceeds the second reference value Vol_M (no at S253), the printer 1 performs the wiping of the first nozzle surface 23 (S261), and when the use amount of the white ink is equal to or less than the second reference value Vol_M (yes at S253), the printer 1 does not perform the wiping of the first nozzle surface 23 (S241).

For example, when the integrated value Vol_W reaches or exceeds the first reverence value Vol_H during the base printing (yes at S210), the CPU 70 advances the processing to S261 and S262 and temporarily ends the present routine. More specifically, when the use amount of the white ink is equal to or more than the first reference value Vol_H, the printer 1 performs the wiping of the first nozzle surface 23 and the flushing of the first nozzle holes 24.

When the use amount of the white ink is small (no at S210) and the non-ejection state of the white ink occurs (yes at S211), the CPU 70 increments the number of empty feeds W-npr_scan by one (S250) and advances the processing to S251. The processing from S251 onward is the same as that described above. That is, when the number of empty feeds W-npr_scan reaches or exceeds the reference number of empty feeds no_print_scan (yes at S252), immediately before the next ejection of the white ink (yes at S251), the printer 1 performs the flushing of the first nozzle holes 24 (S241 or S261). When the use amount of the white ink exceeds the second reference value Vol_M (no at S253), the printer 1 performs the wiping of the first nozzle surface 23 (S261), and when the use amount of the white ink is equal to or less than the second reference value Vol_M (yes at S253), the printer 1 does not perform the wiping of the first nozzle surface 23 (S241).

The processing relating to humidity will be explained. When the use amount of the white ink is small or when the non-ejection state of the white ink continues, the possibility of the occurrence of a viscosity increase or solidification of the white ink adhered to the first nozzle surface 23 further increases as the humidity decreases. Therefore, when the cumulative number of scans Pr_scan reaches the reference number of scans FL*scan (yes at S222) and the humidity Hm is less than the threshold humidity Hm0 (no at S223), the CPU 70 determines that the wiping of the first nozzle surface 23 is to be performed and the flushing of the first nozzle holes 24 is to be performed (S261).

Figure 9:
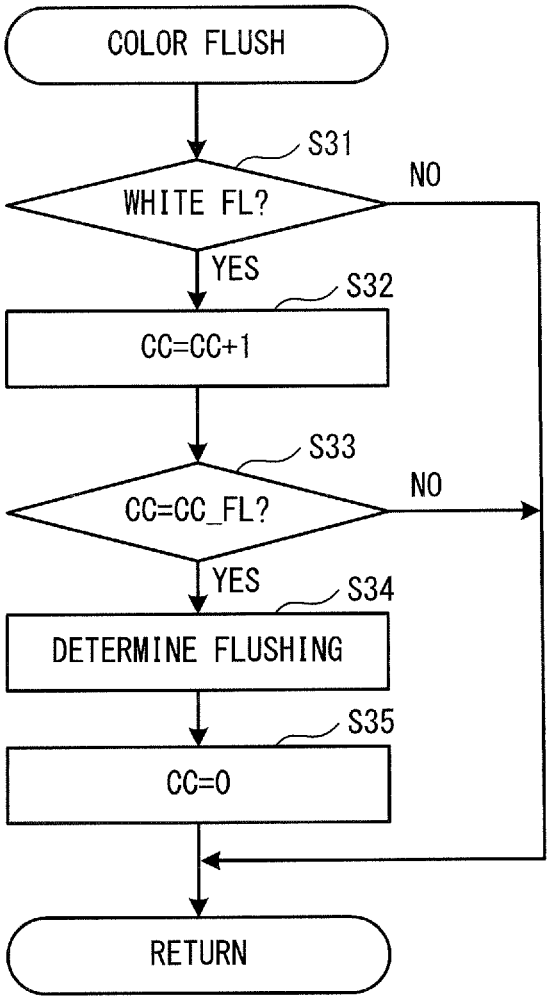
FIG. 9 is a flowchart showing an example of the recovery control according to the embodiment.

The CPU 70 activates a color flushing determination routine shown in FIG. 9 at a predetermined time point. For example, the predetermined time point is immediately after the completion of the white wiping/flushing determination routine shown in FIG. 7 and FIG. 8. The color flushing determination routine does not include processing to stand by for particular processing in the printer 1 or a particular input into the CPU 70. Therefore, this routine is complete in a very short time (for example, a time period less than the time period required for the carriage 3 to move by one dot).

The color flushing determination routine shown in FIG. 9 will be explained. The CPU 70 determines whether or not the execution of the flushing of the first nozzle holes 24 has been determined by the white wiping/flushing determination routine (refer to FIG. 7 and FIG. 8) completed immediately before the present routine (S31). When the execution of the flushing of the first nozzle holes 24 has not been determined (no at S31), the CPU 70 skips all the processing from S32 onward and temporarily ends the present routine. In summary, the printer 1 does not perform the flushing of the second nozzle holes 26.

When the execution of the flushing of the first nozzle holes 24 has been determined (yes at S31), the CPU 70 increments the value of a counter CC by one (S32). The CPU 70 determines whether or not the value of the counter CC has reached a predetermined value CC_FL. The predetermined value CC_FL is an integer of 1 or more. When the value of the counter CC has not reached the predetermined value CC_FL (no at S33), the CPU 70 skips all the processing from S34 onward and temporarily ends the present routine. In summary, the printer 1 does not perform the flushing of the second nozzle holes 26.

When the execution of the flushing of the first nozzle holes 24 has been determined (yes at S31) and the value of the counter CC has reached the predetermined value CC_FL (yes at S33), the CPU 70 determines that the flushing of the second nozzle holes 26 is to be performed (S34), resets the value of the counter CC to an initial value of 0 (S35), and temporarily ends the present routine. More specifically, the printer 1 performs the recovery processing of the second nozzle holes 26 at the time of the recovery processing of the first nozzle holes 24, once in every M times (M=CC_FL) of the recovery processing of the first nozzle holes 24.

MODIFIED EXAMPLES

The present disclosure is not limited to the above-described embodiment. Various modifications can be made to the above-described embodiment. Representative modified examples will be explained below. The modified examples are also not limited to those described below. One or more of the plurality of modified examples can be combined with the above-described embodiment. A part of one of the modified examples and a part of another modified example can be combined with the above-described embodiment.

The application target of the present disclosure is not limited to the printer 1 that uses a cloth as the print medium. For example, the printer 1 may be capable of printing on paper and an OHP sheet etc. The mechanical structure of the printer 1 is not limited to the specific examples shown in the above-described embodiment. For example, the first head portion 21 and the second head portion 22 may be individually attachable to and detachable from the carriage 3 or may be integrally attachable to and detachable from the carriage 3. In other words, the first head portion 21 and the second head portion 22 may be integrated with each other. The first head portion 21 may be disposed to the front of the second head portion 22, or may be disposed to the left or right of the second head portion 22. Both the first nozzle surface 23 and the second nozzle surface 25 may be provided on the single head 2, and the arrangement form of the first nozzle surface 23 and the second nozzle surface 25 is optional. The aforementioned head 2 provided with both the first nozzle surface 23 and the second nozzle surface 25 may be provided singularly or may be provided in a plurality in the printer 1. In contrast to the above-described embodiment, the carriage 3 may move in the sub-scanning direction and the platen 51, namely, the print medium, may move in the main scanning direction. The head 2 may be fixed to the upper frame body 4 and the platen 51 may move in the main scanning direction and the sub-scanning direction. The second recovery portion 62 need not necessarily be provided with the wiper 65 and the wiper cleaner 66. The waste ink reservoir provided in the flushing portion 64 of the first recovery portion 61, and the waste ink reservoir provided in the flushing portion 64 of the second recovery portion 62 may be formed as an integrated body or may be formed as separate bodies.

All or a part of the recovery control program may be stored in the ROM 71. In other words, the recovery control program can be stored in various storage devices that can be read by the CPU 70. A typical example of the aforementioned storage devices is a non-transitory storage medium, such as a hard disk drive (HDD). The non-transitory storage medium need not necessarily include a transitory storage medium, such as a transmission signal.

A control portion and a processor of the present disclosure are not limited to the CPU 70, and other electronic devices, such as an application specific integrated circuit (ASIC) or a field programmable gate array (FPGA), may be used. More specifically, for example, the ASIC can be used in place of the CPU 70, the ROM 71, the NVRAM 72 and the RAM 73. Functions of the control portion and the processor of the present disclosure can be distributed to electronic devices, such as a plurality of CPUs. In other words, each of the steps of the above-described flowcharts may be performed through distributed processing by the plurality of electronic devices.

The printer 1 may receive the temperature Tr or a signal corresponding to the temperature Tr from the external device 96 and the like. In other words, the temperature sensor 92 can be omitted. Similarly, with respect to the humidity Hm, the humidity sensor 93 can be omitted.

With respect to each of the processing steps of the above-described embodiment, an order of the steps can be changed and omission or addition of the steps can be made if necessary. For example, S223 can be omitted. In this case, a structural element relating to the acquisition of humidity, such as the humidity sensor 93, can be omitted. S242 can be omitted. More specifically, the white ink ejection amount during flushing need not necessarily be added to the integrated value Vol_W.

The initial value at the time of resetting may be a number other than 0. The reference number of scans FL*scan may be changed by an operation of the user. The predetermined number of scans N_W-P may be 1, for example. In addition to those described above, the constant and the like used in the above-described specific examples can be changed as appropriate.

In the above-described embodiment, a detailed explanation of the wiping of the second nozzle surface 25 is omitted. However, the wiping of the second nozzle surface 25 can be performed at an appropriate timing. For example, when the CPU 70 determines the execution of the wiping of the first nozzle surface 23, the CPU 70 can also determine the execution of the wiping of the second nozzle surface 25. The CPU 70 can perform the determination processing of the wiping of the second nozzle surface 25 using a routine similar to the color flushing determination routine shown in FIG. 9. More specifically, in a similar manner to the flushing, also with respect to the wiping, the recovery processing for the second head portion 22 can be synchronized with the recovery processing for the first head portion 21.

The printer 1 can perform the purge operation at an appropriate timing. For example, at S261, the CPU 70 can also determine the execution of the purge operation. At S261, the CPU 70 can determine the execution of the purge operation instead of the execution of the flushing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head configured to eject, onto a print medium, a first ink for base printing and a second ink for image printing to be printed on the base printing, the head including a first nozzle surface in which a first nozzle hole being formed and a second nozzle surface in which a second nozzle hole being formed, the first nozzle hole being configured to eject the first ink, and the second nozzle hole being configured to eject the second ink;

a recovery portion configured to perform recovery processing, the recovery processing recovering an ejection performance of the first ink of the head, the recovery portion including a wiper configured to wipe the first nozzle surface, and configured to perform the wiping of the first nozzle surface by the wiper and perform flushing of the first nozzle hole and the second nozzle hole;

a processor; and a memory storing computer-readable instructions, when executed by the processor, perform processes comprising:

acquiring an integrated value of an ejection amount of the first ink; and determining, based on the acquired integrated value, whether to perform the recovery processing by the recovery portion, the recovery processing being one of execution of the wiping of the first nozzle surface by the wiper and execution of the flushing of the first nozzle hole and non-execution of the wiping of the first nozzle surface by the wiper and execution of the flushing of the first nozzle hole.

2. The print device according to claim 1, wherein the head is configured to perform a print operation by ejecting at least one of the first ink and the second ink during a relative movement in a main scanning direction with respect to the print medium, while repeating the relative movement in the main scanning direction and a relative movement in a sub-scanning direction with respect to the print medium, the sub-scanning direction intersecting the main scanning direction, and the computer-readable instructions, when executed by the processor, further perform processes comprising:

acquiring a number of scans, the number of scans being the number of times of the relative movement of the head in the main scanning direction with respect to the print medium;

determining execution of the wiping of the first nozzle surface by the wiper and execution of the flushing of the first nozzle hole when the integrated value is equal to or more than a first reference value; and performing, when the integrated value is less than the first reference value, the recovery processing in accordance with the number of scans.

3. The print device according to claim 2, wherein the computer-readable instructions, when executed by the processor, further perform processes comprising:

acquiring a number of empty feeds, as the number of scans, the number of empty feeds being a number of times that the head relatively moves in the main scanning direction with respect to the print medium in a state in which the first ink is not ejected during the print operation;

determining execution of the wiping of the first nozzle surface by the wiper and execution of the flushing of the first nozzle hole when the integrated value is equal to or more than the first reference value;

determining non-execution of the wiping of the first nozzle surface by the wiper and execution of the flushing of the first nozzle hole when the integrated value is less than the first reference value, the number of empty feeds is equal to or more than a reference number of empty feeds, and the integrated value is equal to or less than a second reference value, the second reference value being smaller than the first reference value; and determining execution of the wiping of the first nozzle surface by the wiper and execution of the flushing of the first nozzle hole when the integrated value is less than the first reference value, the number of empty feeds is equal to or more than the reference number of empty feeds, and the integrated value exceeds the second reference value.

4. The print device according to claim 3, wherein the computer-readable instructions, when executed by the processor, further perform processes comprising:

determining non-execution of the wiping of the first nozzle surface by the wiper and execution of the flushing of the first nozzle hole when the integrated value is less than the first reference value, the ejection of the first ink is scheduled during a time period from the relative movement of the head performed this time in the main scanning direction with respect to the print medium to a predetermined number of relative movements in the main scanning direction, the number of empty feeds is equal to or more than the reference number of empty feeds, and the integrated value is equal to or less than the second reference value; and determining execution of the wiping of the first nozzle surface by the wiper and execution of the flushing of the first nozzle hole when the integrated value is less than the first reference value, the ejection of the first ink is scheduled during the time period from the relative movement of the head performed this time in the main scanning direction with respect to the print medium to the predetermined number of relative movements in the main scanning direction, the number of empty feeds is equal to or more than the reference number of empty feeds, and the integrated value exceeds the second reference value.

5. The print device according to claim 4, wherein the computer-readable instructions, when executed by the processor, further perform processes comprising:

acquiring, as the number of scans, a cumulative number of times of the relative movement of the head in the main scanning direction with respect to the print medium; and determining execution of the flushing of the first nozzle hole in accordance with whether the integrated value is equal to or less than a third reference value, when the integrated value is less than the first reference value and the cumulative number of times reaches a reference number of scans, the third reference value being smaller than the second reference value.

6. The print device according to claim 5, wherein the computer-readable instructions, when executed by the processor, further perform processes comprising:

determining non-execution of the wiping of the first nozzle surface by the wiper and execution of the flushing of the first nozzle hole when the integrated value is equal to or less than a third reference value; and determining non-execution of the wiping of the first nozzle surface by the wiper and non-execution of the flushing of the first nozzle hole when the integrated value exceeds the third reference value.

7. The print device according to claim 1, wherein the head includes a first head portion having the first nozzle surface, and a second head portion having the second nozzle surface, the first head portion and the second head portion being configured to integrally and relatively move with respect to the print medium in a main scanning direction and a sub-scanning direction, the sub-scanning direction intersecting the main scanning direction, the head is configured to perform a print operation by ejecting at least one of the first ink and the second ink during the relative movement in the main scanning direction with respect to the print medium, while repeating the relative movement of the first head portion and the second head portion with respect to the print medium in the main scanning direction and the sub-scanning direction, and the computer-readable instructions, when executed by the processor, further perform a process comprising:

determining execution of the flushing of the second nozzle hole, the flushing of the second nozzle hole is performed based on the performing of the flushing of the first nozzle hole.

8. The print device according to claim 7, wherein the flushing of the second nozzle hole is executed once in every predetermined times of the flushing of the first nozzle holes.

9. The print device according to claim 1, wherein the head is configured to eject the first ink containing a component having a higher settleability than a component contained in the second ink.

10. The print device according to claim 9, wherein the head is configured to eject a white ink as the first ink.

11. A non-transitory computer-readable medium storing computer-readable instructions, the instructions, when executed by a processor of a print device including a head configured to eject a first ink for base printing and a second ink for image printing to be printed on the base printing, the head including a first nozzle surface in which a first nozzle hole being formed and a second nozzle surface in which a second nozzle hole being formed, the first nozzle hole being configured to eject the first ink, the second nozzle hole being configured to eject the second ink, and a recovery portion configured to perform recovery processing to recover an ejection performance of the first ink of the head, the recovery portion including a wiper configured to wipe the first nozzle surface, and configured to perform the wiping of the first nozzle surface by the wiper and perform flushing of the first nozzle hole and the second nozzle hole, perform processes comprising:

acquiring an integrated value of an ejection amount of the first ink; and determining, based on the acquired integrated value, whether to perform the recovery processing by the recovery portion, the recovery processing being one of execution of the wiping of the first nozzle surface by the wiper and execution of the flushing of the first nozzle hole and non-execution of the wiping of the first nozzle surface by the wiper and execution of the flushing of the first nozzle hole.

12. A print device comprising:

a head configured to eject, onto a print medium, a first ink for base printing and a second ink for image printing to be printed on the base printing, the head including a first nozzle surface in which a first nozzle hole being formed and a second nozzle surface in which a second nozzle hole being formed, the first nozzle hole being configured to eject the first ink, the second nozzle hole being configured to eject the second ink, the head including a first head portion having the first nozzle surface and a second head portion have the second nozzle surface, the first head portion and the second head portion being configured to integrally and relatively move with respect to the print medium, by being mounted on a carriage configured to relatively move with respect to the print medium in a main scanning direction and a sub-scanning direction, the sub-scanning direction intersecting the main scanning direction, the head configured to perform a print operation by ejecting at least one of the first ink and the second ink during the relative movement in the main scanning direction with respect to the print medium, while repeating the relative movement of the first head portion and the second head portion with respect to the print medium in the main scanning direction and the sub-scanning direction;

a recovery portion configured to perform recovery processing, the recovery processing recovering an ejection performance of the first ink of the head, the recovery portion including a wiper configured to wipe the first nozzle surface, and configured to perform the wiping of the first nozzle surface by the wiper and perform flushing of the first nozzle hole and the second nozzle hole;

a processor; and a memory storing computer-readable instructions, when executed by the processor, perform processes comprising:

acquiring an integrated value of an ejection amount of the first ink;

determining, based on the acquired integrated value, whether to perform the recovery processing by the recovery portion; and determining execution of the flushing of the second nozzle hole, the flushing of the second nozzle hole is performed based on the performing of the flushing of the first nozzle hole.

13. A print device comprising:

a head configured to eject, onto a print medium, a first ink for base printing and a second ink for image printing to be printed on the base printing;

a recovery portion configured to perform recovery processing, the recovery processing recovering an ejection performance of the first ink of the head, the recovery portion including a wiper configured to wipe a first nozzle surface;

a processor; and a memory storing computer-readable instructions, when executed by the processor, perform processes comprising:

acquiring an integrated value of an ejection amount of the first ink;

determining execution of the wiping of the first nozzle surface by the wiper and execution of the flushing of a first nozzle hole when the integrated value is equal to or more than a first reference value; and adding, when the integrated value is less than the first reference value and the flushing of the first nozzle hole is performed, the ejection amount of the first ink used in the flushing of the first nozzle hole to the integrated value.

* * * * *